United States Patent [19]

Weidman

[11] Patent Number: 5,024,131

[45] Date of Patent: Jun. 18, 1991

[54] DUCT BOARD CUTTER

[76] Inventor: Roger F. Weidman, 2900 W. 55th St. South, Wichita, Kans. 67217

[21] Appl. No.: 326,088

[22] Filed: Mar. 20, 1989

[51] Int. Cl.[5] ..... B26D 3/06

[52] U.S. Cl. ..... 83/875; 83/436; 83/857

[58] Field of Search ..... 83/875, 39, 56, 424, 83/425.3, 436, 856, 857

[56] References Cited

U.S. PATENT DOCUMENTS

| | | | |
|---|---|---|---|
| 3,515,019 | 6/1970 | Tyler, Jr. | 83/875 X |
| 3,596,356 | 8/1971 | O'Neal | 83/875 X |
| 3,605,534 | 9/1971 | Barr | 83/875 X |
| 3,605,537 | 9/1971 | Pickler | 83/433 X |
| 3,863,530 | 2/1975 | Weidman | 83/875 X |
| 3,875,835 | 4/1975 | Roberts | 83/875 X |
| 3,941,018 | 3/1976 | Williams | 83/436 X |
| 3,996,824 | 12/1976 | Cailey | 83/651 X |
| 4,070,954 | 1/1978 | Cailey | 493/19 |
| 4,091,697 | 5/1978 | Cailey | 83/875 X |
| 4,342,349 | 8/1982 | Lipman | 83/875 |
| 4,754,678 | 7/1988 | Nichols et al. | 83/875 X |

*Primary Examiner*—Douglas D. Watts
*Assistant Examiner*—Rinaldi Rada
*Attorney, Agent, or Firm*—John Wade Carpenter

[57] ABSTRACT

A machine for forming a formation in a sheet of material. The machine has a pair of upper and lower rollers which are driven rotatably by a motor. A single, stationary cutting bar is provided in an off-set position with respect to a center line of a rectangular opening in the frame of the machine. A blade assembly is laterally mounted to the frame across the rectangular opening. As the blade assembly is moved laterally closer to the cutting bar, the blade assembly produces a deeper cut into a sheet of material passing between the upper and lower rollers than if the blade assembly had not been moved laterally or had been moved laterally away from the cutting bar which would have produced a more shallow cut or a cut with less depth.

5 Claims, 7 Drawing Sheets

FIG. 2
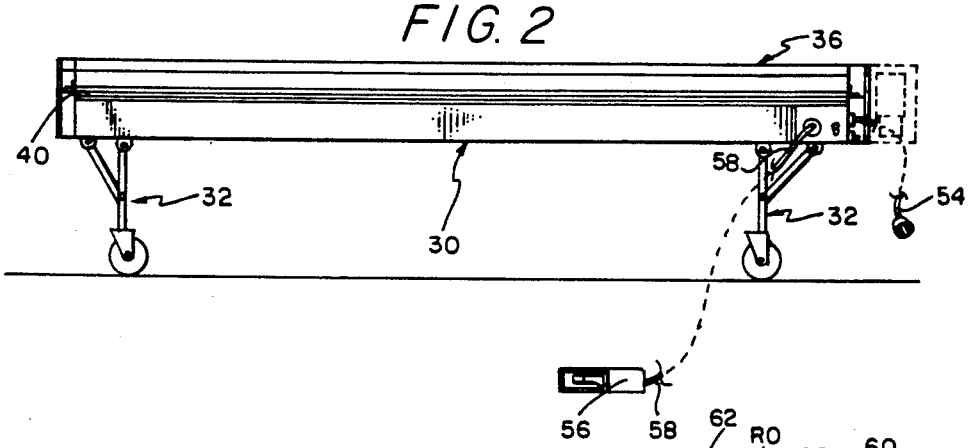
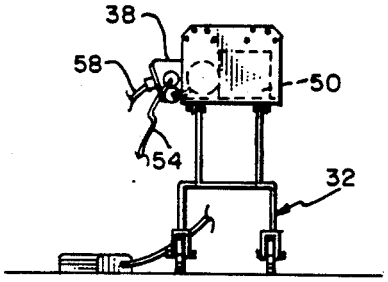
FIG. 3
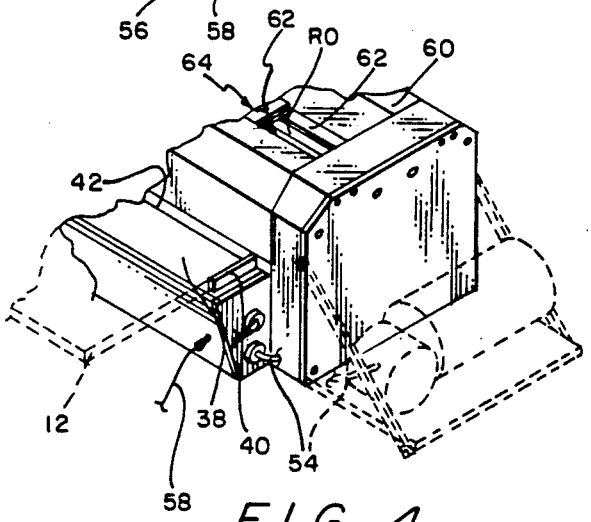
FIG. 4
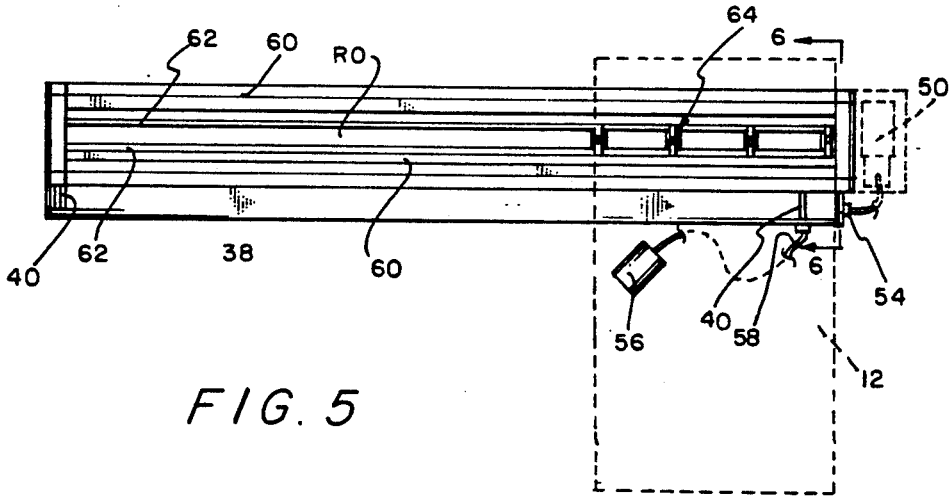
FIG. 5

FIG. 6
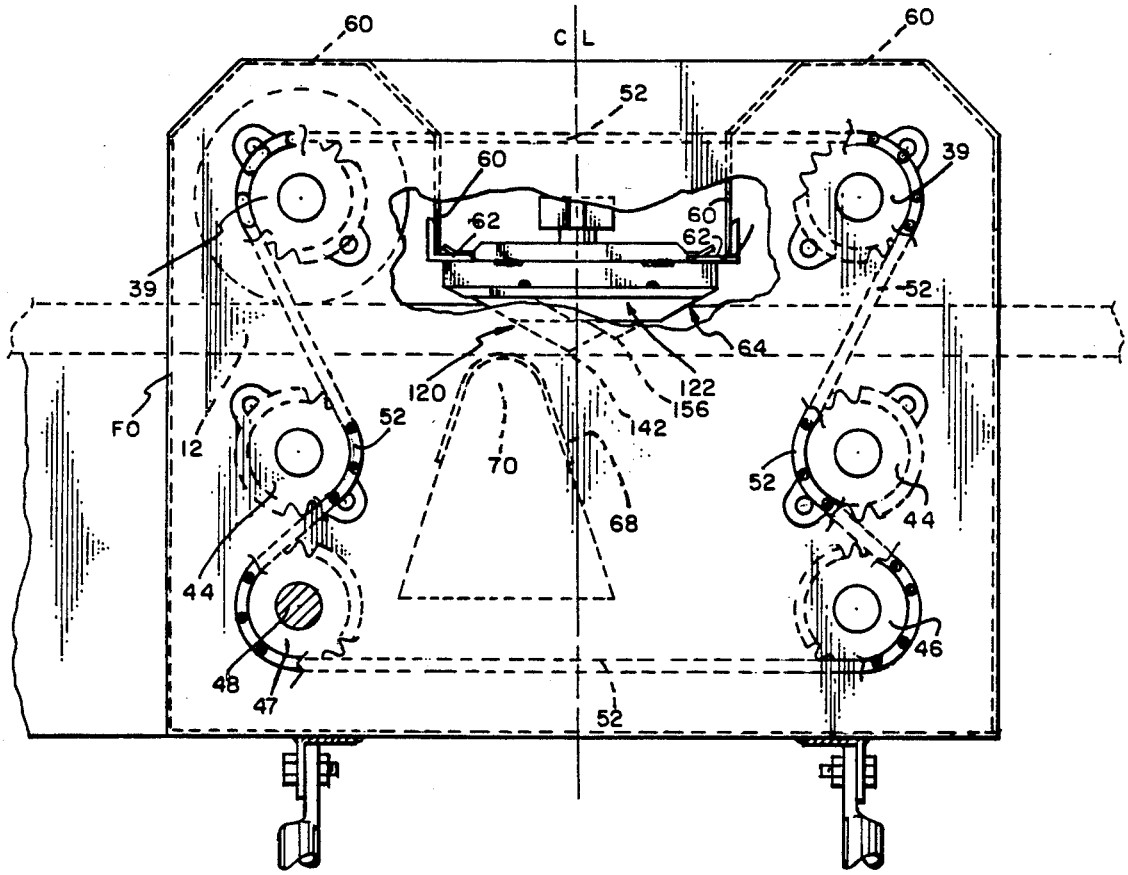
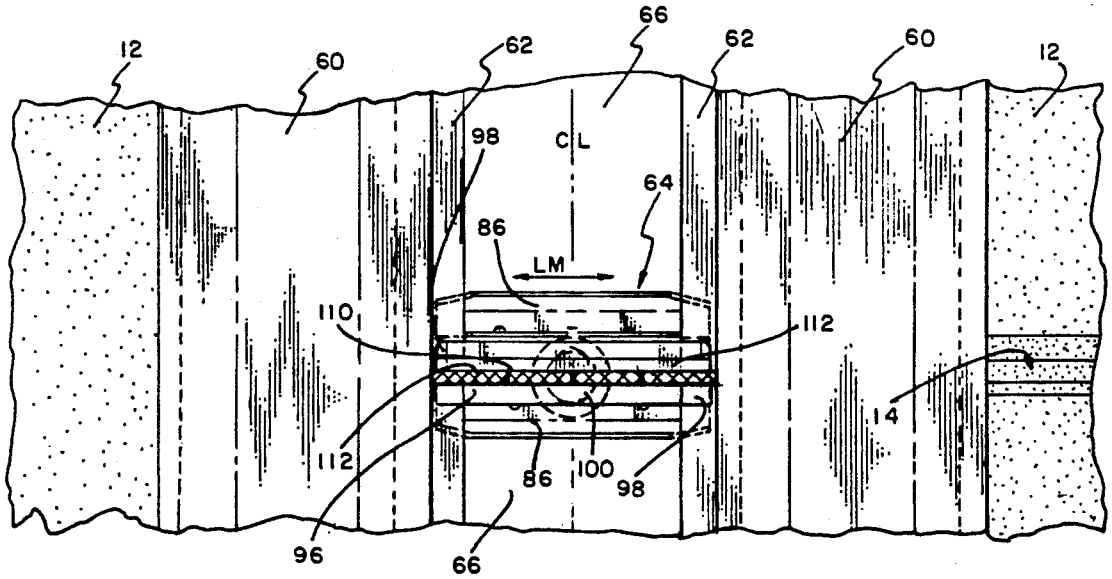
FIG. 7

FIG. 8
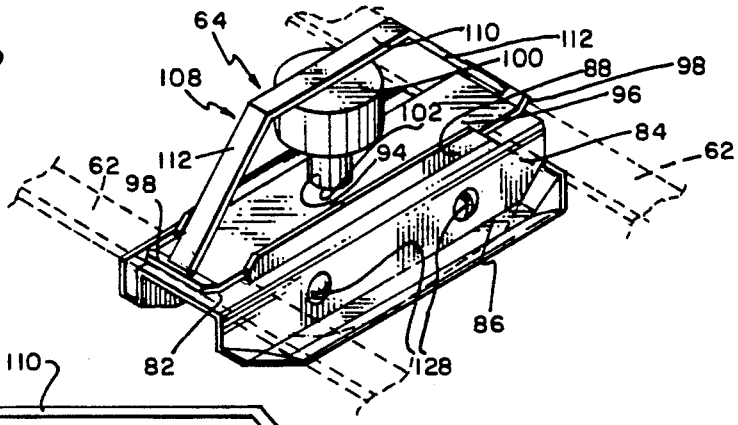
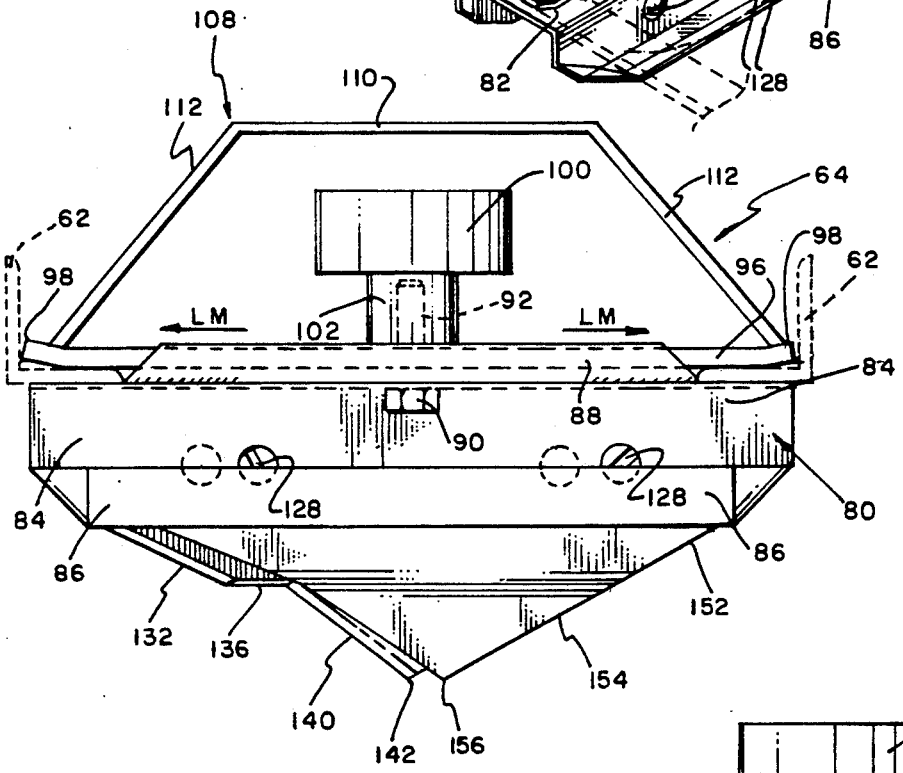
FIG. 9
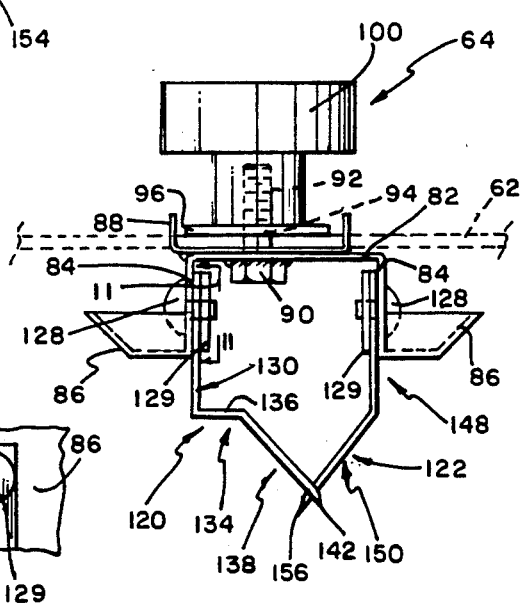
FIG. 10
FIG. 11
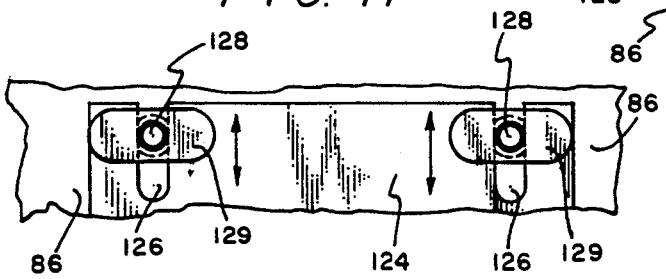

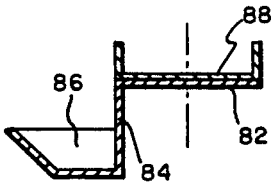
FIG. 14
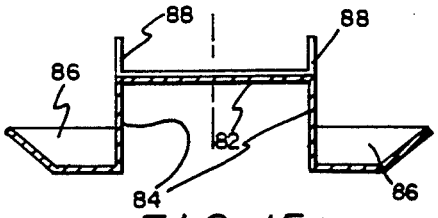
FIG. 15
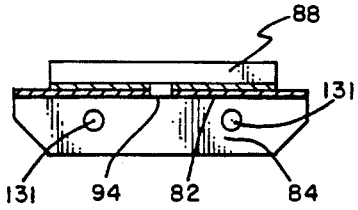
FIG. 16
FIG. 17
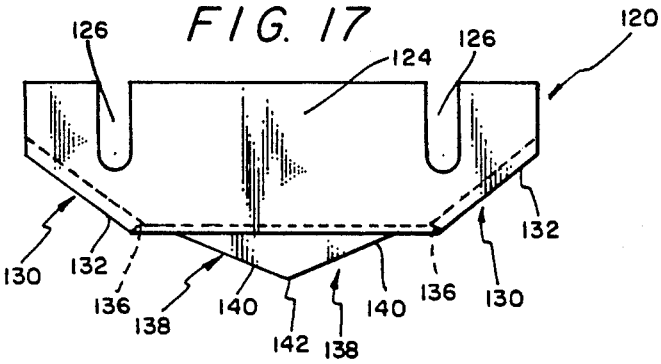
FIG. 18
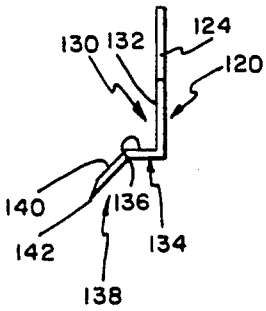
FIG. 19
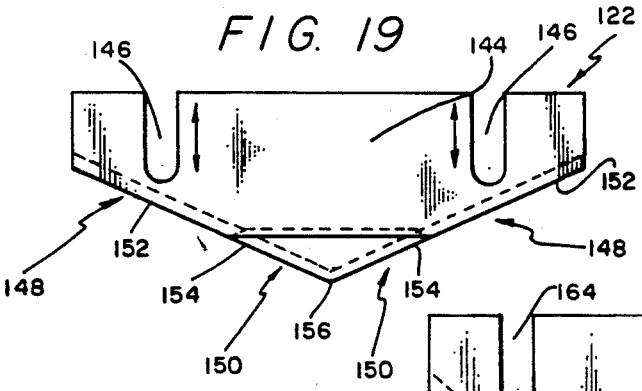
FIG. 20
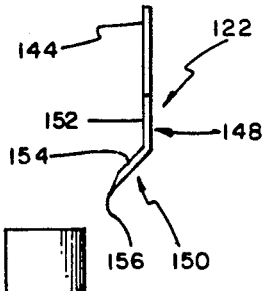
FIG. 21
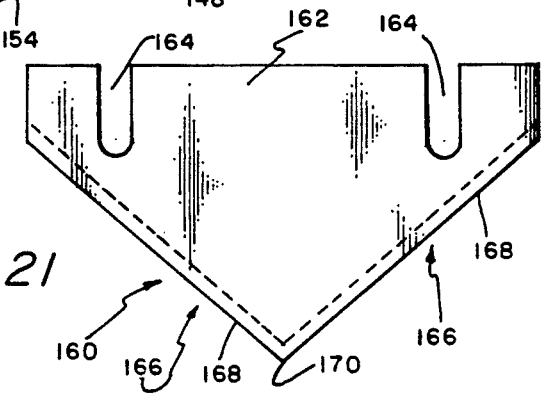

FIG. 22
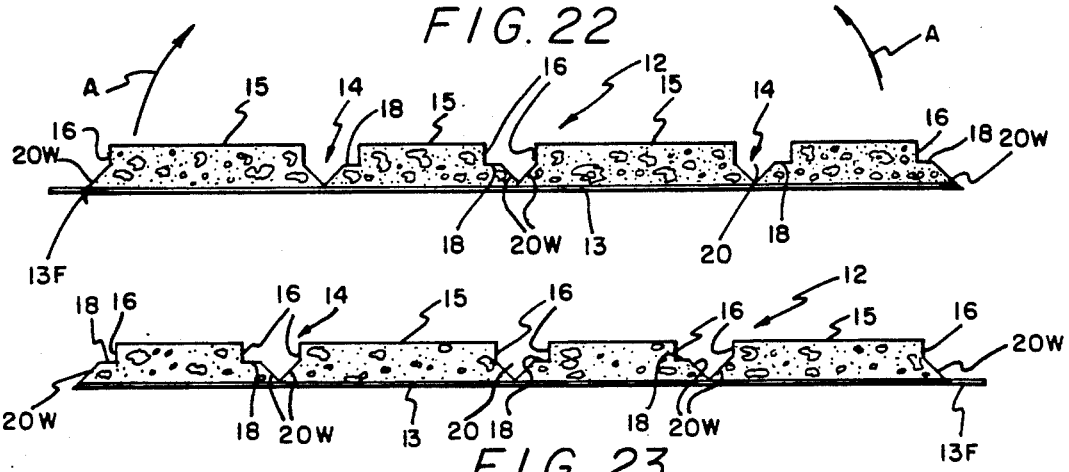
FIG. 23
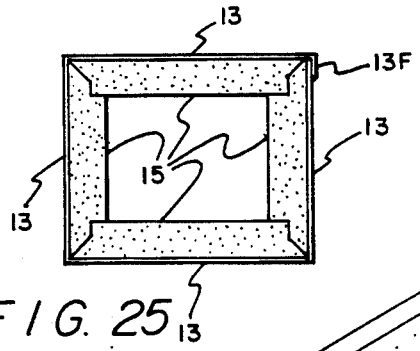
FIG. 25
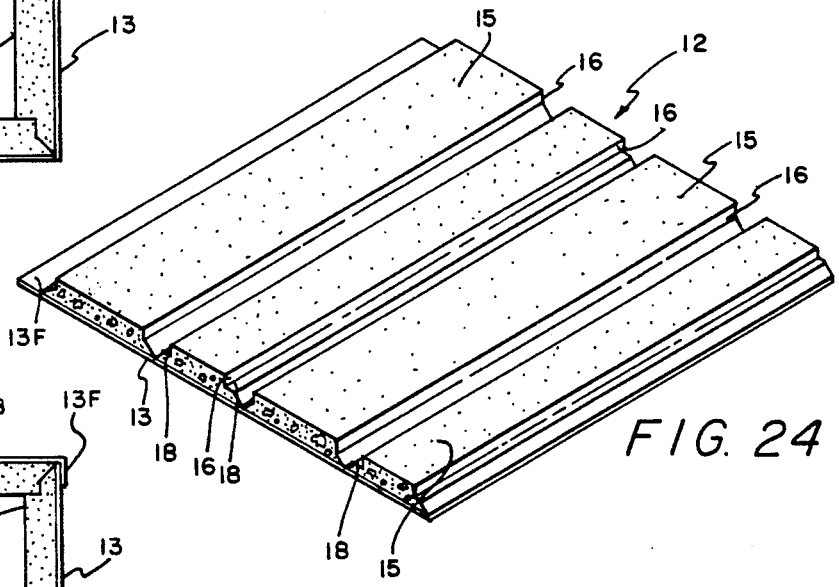
FIG. 24
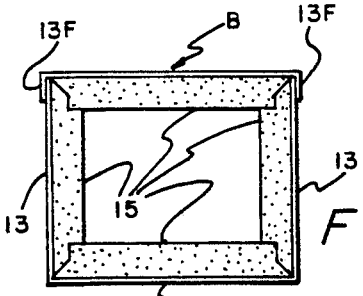
FIG. 28
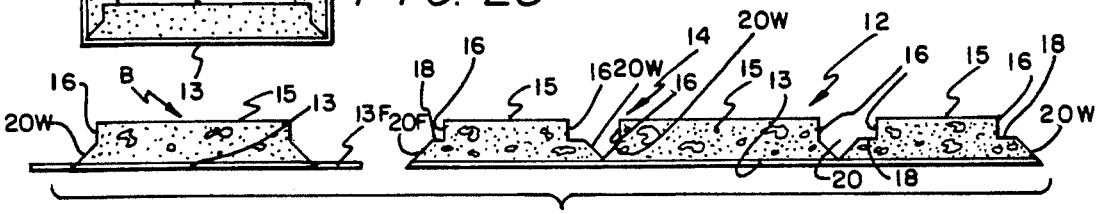
FIG. 26
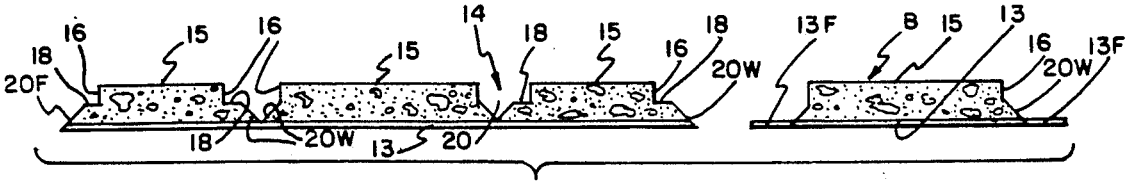
FIG. 27

DUCT BOARD CUTTER

FIELD OF THE INVENTION

This invention is related to a machine for cutting formations in sheets of material for use in the manufacture of ventilation ducts and like structure. More specifically, this invention provides a machine and method whereby ventilation ducts can be manufactured with a blade assembly or cutting tool whose depth of cut into the sheets of material can be adjusted such that the cutting tool does not go through the sheet material. Typically, sheet material such as fiberglass boards have an impermeable barrier or foil which is not to be severed or torn during cutting operations where strips are removed from the sheet material.

DESCRIPTION OF THE PRIOR ART

The prior art is abundant with various types of machines for cutting fiberglass board of the type having an impermeable barrier, such as foil, on one face thereof. By way of example only, the following U.S. Pat. Nos. pertain to board cutting machines: U.S. Pat. No. 3,605,537 to Pickler; U.S. Pat. No. 3.941,018 to Williams, U.S. Pat. No. 3,996,824 to Cailey, U.S. Pat. No. 4,070,954 to Cailey, and U.S. Pat. No. 4,091,697, also to Cailey. None of the foregoing prior art patents teach or suggest the particular machine for cutting fiberglass board.

SUMMARY OF THE INVENTION

The present invention accomplishes its desired objects by broadly providing a machine for forming a formation in a sheet of material, typically a board of fiberglass. The machine includes a pair of upper and lower rollers rotatably secured to a frame. The frame comprises a pair of spaced lip means defining a generally rectangular opening having a center line. A single, stationary cutting bar means is secured to the frame underneath the rectangular opening and in an off-set position with respect to the center line. The upper and lower rollers are rotated on the frame by a motor. As the motor causes the rollers to rotate, a sheet of material passes through the frame. A blade assembly means is removably mounted on the pair of spaced lips and is adapted to adjust laterally across the rectangular opening. As the blade assembly is moved laterally towards the cutting bar and towards a feed opening in the frame wherethrough a sheet of material passes, the blade assembly cuts the sheet of material at a greater depth than if the blade assembly had not been moved laterally towards the cutting bar. Stated alternatively, the closer the blade assembly is moved towards the cutting bar, the greater the depth of cut into a sheet of material; and, vice versa in that the further away the blade assembly means is moved from the cutting bar, the less depth of cut the blade assembly performs on the sheet of material that is being passed through the feed opening and through the upper and lower rollers.

The present invention further accomplishes its desired objects by providing a blade assembly for a board cutting machine. The blade assembly comprises a first blade means and a second blade means. Both the first and second blade means assist in cutting a strip of board material from a board. Preferably, the first blade means comprises a support section adapted to be attached to a blade support means. A first cutting edge extends from the support section towards the board to be cut and towards the strip to be cut at an angle that is generally normal to a face of the board to be cut. A second cutting edge extends from the first cutting edge towards the strip and generally parallel to the face of the board to be cut. The first blade means further includes a third cutting edge that extends from the second cutting edge and towards the strip to be cut at a generally oblique angle to a plane normal to the face of the board to be cut. The second blade means also includes a support section adapted to be attached to the blade support means. The second blade means comprises a first cutting edge extending from the second blade support section towards the board to be cut and towards the strip to be cut at an angle that is generally normal to a face of the board to be cut, and a second cutting edge extending from the first cutting edge and towards the strip to be cut at a generally oblique angle to a plane normal to the face of the board to be cut.

It is therefore an object of the present invention to provide a blade assembly for a board cutting machine.

It is a further object of the present invention to provide a blade for a board cutting machine.

Still further objects of the invention provide for a machine for forming a formation in a sheet of material, a process for controlling the depth of cut of a blade assembly means into a sheet of material to be passed through a machine for forming a formation in a sheet of material, and a process for forming a formation in a sheet of material.

These, together with the various ancillary objects and features which will become apparent to those skilled in the art as the following description proceeds, are attained by these novel apparatuses and process, a preferred embodiment being shown with respect to the accompanying drawings, by way of example only, wherein:

BRIEF DESCRIPTION OF THE DRAWINGS

FIG. 2 is a front elevational view of the machine of FIG. 1;

FIG. 3 is an end elevational view of the machine of FIG. 1;

FIG. 4 is a partial perspective end view of the machine of FIG. 1;

FIG. 5 is a top plan view of the machine of FIG. 1;

FIG. 6 is a vertical sectional view taken in direction of the arrows and along the plane of line 6—6 in FIG. 5;

FIG. 7 is an enlarged partial top plan view of the blade assembly means slidably engaged by a pair of angle irons such that the blade assembly can move laterally in direction of the arrow;

FIG. 8 is a partial perspective view of the blade assembly of this invention;

FIG. 9 is a side elevational view of the blade assembly;

FIG. 10 is an end elevational view of the blade assembly of FIG. 8;

FIG. 11 is a partial vertical sectional view taken in direction of the arrows and along the plane of line 11—11 in FIG.

FIG. 14 is a partial vertical sectional view of the frame for the cutting tool;

FIG. 15 is a vertical sectional view of part of the frame for the cutting tool;

FIG. 16 is a vertical sectional view illustrating part of the frame for the cutting tool;

FIG. 17 is a side elevational view of one of the blades for the cutting tool;

FIG. 18 is an end elevational view of the blade of FIG. 17;

FIG. 19 is a side elevational view of another blade for the cutting tool;

FIG. 20 is an end elevational view of the blade of FIG. 19;

FIG. 21 is a front elevational view of a straight, planar blade which may be employed with the cutting tool;

FIG. 22 is an end elevational view of a sheet of material having a plurality of formations formed therein by the machine of FIG. 1;

FIG. 23 is a rear elevational view of the sheet of material of FIG. 22;

FIG. 24 is a perspective view of the sheet of material of FIGS. 22 and 23;

FIG. 25 is an end elevational view of a duct which was formed by folding the sheet material of FIGS. 22-24 into a generally rectangular posture;

FIG. 26 is an end elevational view of another embodiment of the sheet of material including a bridging member;

FIG. 27 is a rear elevational view of the sheet of material of FIG. 26; and

FIG. 28 is an end elevational view of a duct formed with the sheet of material of FIGS. 26 and 27.

DETAILED DESCRIPTION OF THE INVENTION

Figure 1:
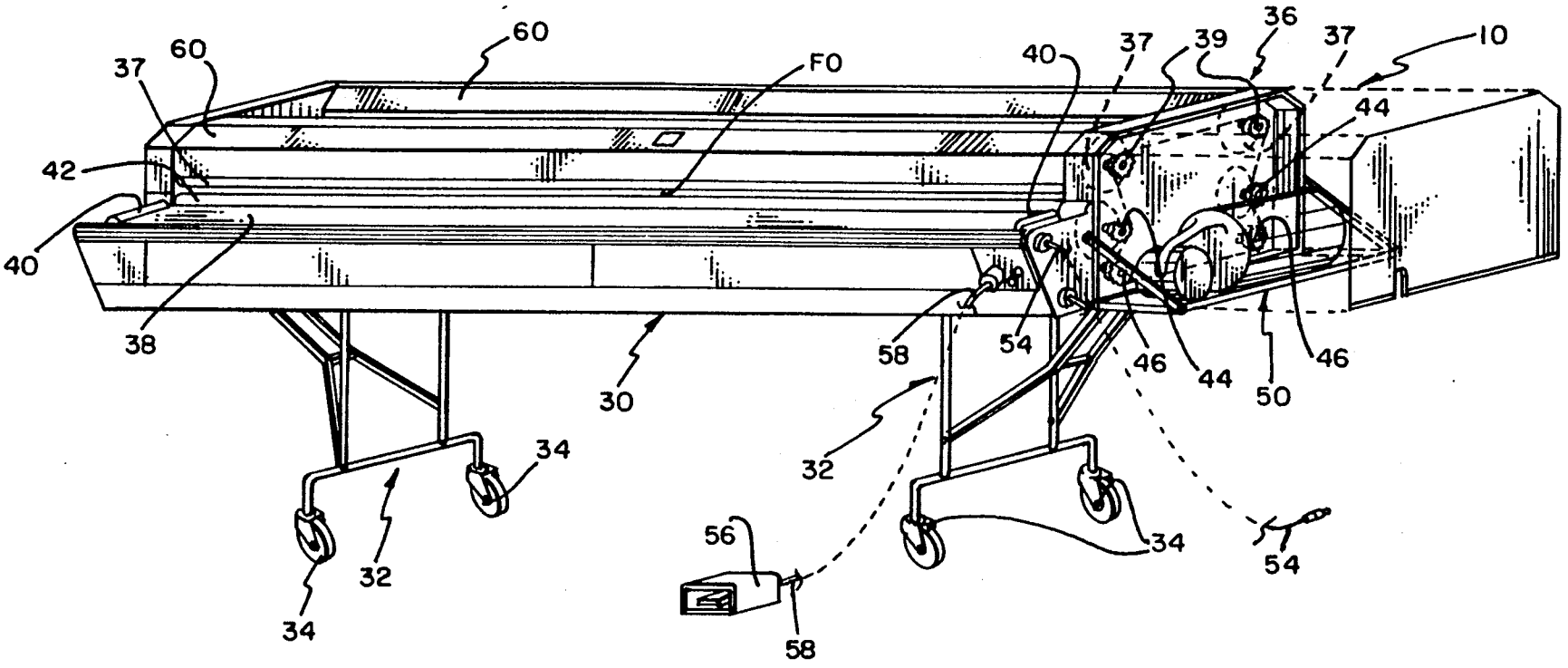
FIG. 1 is a perspective view of the machine of this invention for cutting formations in sheets of material which is used in the manufacture of ventilation ducts.

Referring in detail now to the drawings wherein similar parts of the invention are identified by like reference numerals, there is seen the duct board cutter machine of this invention, generally illustrated as 10 in FIG. 1, and shown in FIG. 5 with a sheet of material 12 (a dotted line representation) therein being cut. The function of the machine 10 is to make cuts or formations in the sheet of material 12 as it is being moved through the machine 10. FIGS. 22, 25, 24, 26 and 27 represent sheets of material 12 having at least one impermeable barrier or foil 13, a side 15 opposed to foil 13, and removed intermediate channels or formations, generally illustrated as 14. Each intermediate formation 14 has a pair of parallel upright side walls 16—16. One of the side walls 16 terminates in a shoulder or ledge 18. At the bottom of each intermediate formation 14 is a V-groove 20 defined by a pair of downwardly sloping walls 20W—20W. Both walls 20W—20W terminate at (or in close proximity thereto) the foil 13. One of the walls 20W terminates in the shoulder 18, the other wall 20W is a sloping downward continuation of one of the upright side walls 16. As seen in FIGS. 22-23, one formation 14 is a mirror image of the other two formations 14—14. When each of the intermediate formations 14 are collapsed by the folding of the sheet material 12 in direction of the arrows A—A in FIG. 22, one wall 20W contacts the other wall 20W and shoulder 18 folds against one of the upright walls 16. The other upright wall 16 (more specifically the particular upright wall 16 that terminates in the shoulder 18) flushes against a portion of one of the sides 15 opposed to foil 13 as evidenced in FIG. 25. The opposed ends of the sheet material 12 in FIGS. 22-25 are structures representing a splitting or a halving of a formation 14. More particularly, one of the opposed ends is defined by wall 16 and wall 20W whereas the other opposed end is defined by wall 16, shoulder 18 and sloping wall 20W. Foil flap 13F protrudes beyond wall 20W for the end having walls 16 and 20W. When the sheet material 12 is folded in direction of the arrows A—A, each intermediate formation 14 collapses and wall 16 and wall 20W on one end (i.e. the end with the flap 13F) flushes or slots against shoulder 18 and wall 20W of the other end, such that the rectangular duct of FIG. 25 is formed. Flap 13F folds over and secures against a portion of the foil 13 to firmly form the rectangular duct of FIG. 25. In FIGS. 26-27, the sheet material 12 is cut such that the opposed ends are identical with wall 16, shoulder 18 and sloping wall 20W. To formulate the rectangular duct of FIG. 25, a bridging sheet material member B (see FIGS. 26 and 27) is needed to form a side of the rectangular duct and bridge the two opposed ends together. Each end of the bridging member B are identical in having upright side wall 16 and the connecting sloping side wall 20W. Bridging member B is flanged by a pair of flaps 13F-13F. These pair of flaps 13F-13F overlap and secured to portions of foil 13 to form the rectangular duct as illustrated in FIG. 28.

The duct board cutter machine 10 comprises a lower body frame, generally illustrated as 30, supported by a pair of folding leg assemblies, each generally illustrated as 32. Each folding leg assembly 32 is supported by locking casters 34. Mounted on top of the lower body frame 30 is an upper body frame, generally illustrated as 36. A pair of upper rollers 37—37 is rotatably positioned in the upper body frame 36. The lower body frame 30 includes a table 38 having a pair of opposed guides 40—40 disposed at the ends thereof. A pair of bottom rollers 42-42 is rotatably positioned in the lower body frame 30 and is generally aligned vertically with respect to said upper rollers 37—37. Formed integrally with an end of each bottom roller 42 is a lower sprocket 44. Similarly, formed integrally with an end of each upper roller 37 is an upper sprocket 39. At the end of a side of the table 38 and formed between one of the upper rollers 37 and one of the bottom rollers 42 is a feed opening FO wherethrough sheet material 12 is passed.

Rotatably positioned to the lower body frame 30 below the lower sprockets 44—44 is an idler sprocket 46 and a motor sprocket 47. Mounted to or on the motor sprocket 47 is a motor shaft 48 which is driven by a motor, generally illustrated as 50. An endless chain 52 is looped to the pair of upper sprockets 39—39, to the pair of lower sprockets 44—44, to the lower sprocket 46, and to the motor sprocket 47. As the motor 50 imparts rotary power to the motor sprocket 47, the endless chain 52 transfers the rotary power from the motor sprocket 47 to the upper sprockets 39—39 and to the lower sprockets 44—44, which respectively causes simultaneously the upper rollers 37—37 and the lower rollers 44—44 to rotate and move any sheet material 12 therein away from the feed opening FO. Power to the motor 50 is conducted through power cord 54. A foot switch 56 with a cord 58 is provided in order that the operator can close the circuit with a foot and energize the motor 50.

The top body frame 36 is formed to have a pair of upper roll covers 60—60 which are respectively superimposed over the top rollers 37—37. The upper roll covers 60—60 are each formed with an upturned lip means such that a generally rectangular opening RO is formed therebetween. The rectangular opening RO has a center line CL which is the midpoint thereof. Preferably, the lip means is provided in the form of an angle iron 62 secured to the terminating lower edge of each of the upper roll covers 60—60. The angle irons 62—62 furnish a support means for receiving at least one blade support means, generally illustrated as 64, such that the blade support means 64 can be moved laterally. One of the salient features of this invention is the ability of the blade support means 64 to be moved laterally, i.e. generally perpendicular to the center line CL. The lateral movement ability of the blade support means 64 is represented by arrow LM in FIG. 7 and FIGS. 12 and 13. A single, stationary cutting bar (generally conical shape in vertical cross section) is represented as 66 and is bound to opposed ends of the lower body frame 30 after traversing the entire rectangular opening RO. The cutting bar 66 optionally includes a cutting cap 68. The cutting bar 66 has an apex (or zenith) 70, optionally covered by the cutting cap 68. Another salient feature of the present invention is that the cutting bar 66 is off-set with respect to center line CL. More specifically, the apex 70 of the cutting bar 66 is off-set towards the feed opening FO (see FIGS. 12 and 13). The combination of the off-set cutting bar 66 with the lateral movement ability of the blade support means 64 enables the operator to control the depth of cut of the blade support means 64 into the sheet material 12. As will be more fully explained below, the cutting depth and quality of cut can also be controlled by adjusting the blades of the blade support means 64 up and down and/or adjusting the blade holders of the same up and down diagonally. Furthermore, the blade support means 64 are reversible upon the angle irons 62—62 for right hand cutting or left hand cutting.  In FIGS. 22, 3 and 5, the motor 50 is positioned to or on the right of the ductboard cutter machine 10 representing right hand cutting, i.e. cutting the material 12 on the right of the cutter machine 10. It is readily apparent that the motor 10 may be positioned on the left of the cutter machine 10, especially when left hand cutting is desired. The present invention includes the motor 10 being positioned at any location on the ductboard cutter machine 10**.

The blade support means 64 of this invention comprises a frame, generally illustrated as 80, comprising a frame top 82, a pair of frame sides 84—84 integrally secured to the frame top 82 and formed with a pair of channeled flanges 86—86. Bound to the frame top 82 is a U-shaped guide 88 (see FIG. 10). A frame shaft 90 having a threaded end 92 passes through the frame top 82 and the guide 88 such as to expose the threaded end 92. Removably disposed through an aperture 94 (see FIG. 10) in a clamping bar 96 (or retainer) is the frame shaft 90. The bar 96 is guided by the U-shaped guide 88 and is formed with a pair of lips 98—98 at opposed ends thereof. The clamping bar 96 is capable of being moved along the vertical axis of the frame shaft 90. As best illustrated in FIG. 9, the clamping bar 96 extends beyond the ends of the U-shaped guide 88 to form a space between the frame top 82 and the clamping bar 96. More specifically, the upturned lips 98—98 extend beyond the ends of the U-shaped guide 88 such as to slidably rest or lodge on the angle iron 62 which lodges in the space formed between the frame top 82 and the clamping bar 96. The length of the U-shaped guide 88 (in combination with the width of rectangular opening RO) is such as to allow lateral movement LM of the blade support means 64. As was previously indicated, the lateral disposition of the blade support means 64 (along with the off-set cutting bar 66) provides for a means of controlling the cutting depth into the sheet material 12. The further towards the feed opening FO the blade support means 64 is set, the deeper the cut. The initial setting of the blade support means 64 is initially accomplished or begun by rotatably connecting an integral shank 102 of a handle means 100 to the threaded end 92 of the frame shaft 90, and rotating the handle means 100 such that the integral shank 102 moves downwardly to clamp or rest against the clamping bar 96. Rotatably tightening further the handle means 100 when the desired position of the clamping bar 96 with respect to the pair of angle irons 62—62 is obtained accomplished the final setting of the blade support means 64. More specifically, when the pair of upturned lips 98—98 of the clamping bar 96 is positioned (after lateral movement LM of the blade support means 64 including the clamping bar 96 and the depending guide 88 and secured frame 80) at a desired location (which depends on the desired depth of cut) on the opposed angle irons 62—62, and the handle 100 is rotated to force the shank 102 downwardly to drive the end portions including the upturned lips 98—98 against the angle irons 62—62 such that the latter is wedged forcedly between the frame top 82 and the end portions and upturned lips 98—98 of the clamping bar 96, the final setting of the blade support means 64 is accomplished. Optionally secured to the upturned lips 98—98 of the clamping bar 96 is a tool handle means 108 having a handle roof 110 and a pair of sloping handle sides 112 secured to the handle roof 110 and to the upturned lips 98—98. The handle means 108 facilitates the adjusting and lateral movement LM of the blade support means 64.

The blade support means 64 additionally comprises a first blade means, generally illustrated as 120, and/or a second blade means, generally illustrated as 122. The first blade means 120 comprises a blade support section 124 having elongated slots 126—126. Blade section 124 connects to a frame side 84 with the assistance of a pair of bolts 128-128 and threaded nuts 129—129. Bolts 128-128 respectively pass through apertures 131—131 (which are formed in the frame sides 84—84) and through the elongated slots 126—126. When nuts 129—129 are tightened firmly against blade support section 124 to flush the same against the frame sides 84, the first blade means 120 is stationarily affixed in place for performing cutting operations. The depth of the cut into the sheet material 12 ca be controlled by sliding the bolts 128—128 in direction of the arrows (in FIG. 11) within the elongated slots 126—126. Movement of the blade support section 124 towards the frame top 82 lessens or shortens the cutting depth, whereas movement away from the frame top 82 such that the bolts 128—128 are being positioned deeper or father into the elongated slots 126—126 extends or increases the depth of cut into the sheet material 12. Furthermore, as was previously mentioned, the depth of cut can be controlled by the lateral movement LM of the blade support means 64 with respect to the angle irons 62—62 and its disposition across rectangular opening RO.

In addition to the blade support section 124, the first blade means 120 comprises a pair of first cutting sections, each generally illustrated as 130 and including a cutting edge 132. The first cutting section 130 extends from the blade support section 124 towards the sheet material 12 being cut at an angle that is generally normal to a face of the sheet material 12 to be cut. A pair of second cutting sections 134—134 with each having a cutting edge 136 is formed to extend from the first cutting sections 130—130 toward the sheet material 12 and generally parallel to the face of the sheet material 12 to be cut. A pair of third cutting sections 138-138 with each having a cutting edge 140 is formed to extend from the second cutting sections 134—134 toward the sheet material 12 at a generally oblique angle to a plane normal to the face of the board to be cut. The pair of cutting edges 140—140 of the third cutting sections 138—138 terminate in a cutting point 142.

The second blade means 122 comprises a blade support section 144 having elongated slots 146—146. Blade support section 144 connects to the frame side 84 opposed to the frame side 84 engaged to the first blade means 120. A pair of bolts 128 and threaded nuts 129—129 assist the securing of the blade support section 144 to the frame side 84. Bolts 128—128 respectively extend through the apertures 131—131 and through the elongated slots 146—146 of the blade support section 144. As was seen for first blade means 120, when nuts 129—129 are tightened firmly against the blade support section 144 to flush the same against the frame side 84, the second blade means 122 is stationarily affixed in place for performing cutting operations, especially in conjunction with the second blade means 122. As was also seen for the first blade means 120, the depth of cut into the sheet material 12 can be controlled by sliding the bolts 128—128 in direction of the arrows (in FIG. 19) within the elongated slots 146—146. Movement of the blade support section 144 towards the frame top 82 lessens or shortens the cutting depth, whereas movement away from the frame top 82 such that the bolts 128—128 are being positioned deeper or farther into the elongated slots 126—126 extends or increases the depth of cut into the sheet material 12. Thus, the combination of the respective positions of the first and second blade means 120 and 122 against the frame sides 84—84, and the disposition of the blade support means 64 across rectangular opening RO and along/on the respective angle irons 62—62 after appropriate lateral movement LM (which determines the distance the blade means 120 and 122 are to the cutting bar 66 as evidenced in FIGS. 12 and 13), all controls and dictates the cutting depth of the first and second blade means 120 and 122 int the sheet material 12.

The second blade means, in addition to the blade support section 124, further comprises a pair of first cutting sections, generally illustrated as 148—148, extending from the blade support section 124 towards the sheet material 12 to be cut at an angle that is generally normal to a face of the sheet material 12 to be cut; and a pair of second cutting sections (each generally illustrated as 150—150) extending from the first cutting sections 148—148 toward the sheet material 12 to be cut at a generally oblique angle to a plane normal to the face of the sheet material 12 to be cut. Each first cutting section 148 has a first cutting edge 152. Similarly, each second cutting section 150 has a second cutting edge 154. The pair of second cutting edges 154—154 terminate in a cutting point 156. As best illustrated in FIGS. 9, 10, 12 and 13, the cutting points 142 and 156 are off-set with respect to each other and are not aligned with respect to each other in a side view. Furthermore, one of the points is lower than the other, preferably (as illustrated in FIG. 10) point 156 is lower than point 142, and neither of the points (i.e., points 156 and 142) are cutting edges.

A third blade means, generally illustrated as 160, is provided in the present invention to be employed optionally with either blade means 120 or blade means 122. Third blade means 160 includes blade support section 162 including a pair of longitudinal slots 164—164, all of which function similarly (with respect to securing to and being adjusted to a frame side 84) to blade support section 124 (including slots 126—126) and blade support section 144 (including slots 146—146). Third blade means 160 includes a pair of cutting sections, each generally illustrated as 166—166 and having a cutting edge 168 extending down from the blade support section 162 towards the sheet material 12 being cut at an angle normal to a face of the sheet material 12 being cut. The pair of cutting edges 168—168 terminate in a cutting point 170 (and not a cutting edge).

With continuing reference to the drawings for operation of the invention, a plurality of the blade support means 64 are spaced apart along the single irons 62—62. The distance of spacing of the respective blade support means 64 depends on the desired length of the sides of the eventually formed duct. If the sides of a square duct are to be 1.0 feet, the spacing distance is 1.0 feet. Similarly, if two of the sides (i.e., opposed sides) are to be 1.5 feet in length, and two sides are to be 1.0 feet to form a rectangular duct, then obviously some of the spacing (i.e., every other one) will be 1.5 feet while the remaining spacing will be 1.0 feet. Furthermore, some of the blade support means 64 are to be rotated in order to produce mirror image formations 14 of the other formations 14. By way of example, the first and third formations 14 in the cut sheet material 12 of FIG. 23 were formed with the sheet material traveling towards the blade means 120 and 122 postured in the end elevational view in FIG. 10. In FIG. 10, cutting section 138 of blade means 120 and cutting section 150 of blade means 122 forms the V-groove 20 to the right of cutting section 134 of blade means 120. If the blade support means 64 is reversed (or turned around) on the angle irons 62—62 such that the sheet material 12 would be approaching the rear (or behind) the blade means 120 and 122 postured in the end elevational view in FIG. 10, the V-shaped groove 20 would be produced to the left of cutting section 134 of the blade means and a mirror imaged formation 14 to the first and third formations 14 would be formed. Such mirror imaged formation 14 is the second formation 14 in the cut sheet material 12 in FIG. 23.

The extreme cuts (which are half of a formation 14) for the cut sheet material 12 in FIGS. 22 and 23 are produced with one extreme blade support means 64 having only the first blade means 120 while the other extreme blade support means 64 has only the second blade means 122. Obviously for the cut sheet material 12 in FIGS. 26 and 27, the extreme cuts are produced with the two extreme blade support means 64 each having only first blade means 120. Similarly, the extreme cuts (which are the only cuts) on opposed sides of the bridging member B are produced with a pair of blade support means 64 having only second blade means 122.

After the desired number of blade support means 64 with the desired number of blades, with the desired appropriate end elevational view facing any incoming uncut sheet material 12 [recognizing the need that at least one of the blade support means 64 is rotated (or turned around) for producing mirror imaged formation 14] and with the appropriate blade(s) disposition(s) against the frame side(s) 84 and with the appropriate lateral movement LM across the rectangular opening RO and the angle irons 62—62, have all been set as desired to obtain the desired depth and cutting quality in producing the desired formations 14, an uncut sheet material 12 with an existing flap 13F is positioned through feed opening FO and between an upper roller 37 and lower roller 44. Thereafter, foot switch 56 is depressed to close the circuit and commence the motor 50 imparting rotational (rotary) power to the upper rollers 37—37 and the lower rollers 44—44 via driven motor sproket 47 trained to the pulley chain 52 trained over sprockets 39—39, sprockets 44—44, and idler sprocket 46. The upper rollers 37—37 rotating in alignment with the rotating lower rollers 42—42 causes the sheet material to pass through the blade means 120 and 122 of the various blade support means 64, causing the desired formations 14 (and the extreme cuts) to be formed by strips of material being removed from the structure of the sheet material 12. The channeled sheet material 12 may now be appropriately folded (such as in direction of the arrows A—A in FIG. 22 as previously indicated) and flap 13F sealed against foil 13 to form the duct of FIG. 25 or FIG. 28.

As has been previously indicated, one of the salient features of the present invention is the lateral disposition of any one of the blade support means 67 to control the cutting depth of the blade means 120 and/or 122 into the sheet material 12. For example, positioning the blade support means 64 closer to the feed opening FO and closer to the cutting bar 66 as in FIG. 12 causes a deeper cut into the sheet material 12, a cut which is in close proximity to the impermeable barrier or foil 13. Positioning the blade support means 64 further away from the feed opening FO and the cutting bar 66 causes a more shallow cut as evidenced in FIG. 13 due primarily to a bending, bowing (or like action) downwardly of the sheet material 12 immediately following the cutting bar 66. Such downward bowing or bending (or bulging) action is due primarily to only a single cutting bar and the increased distance between the apex 70 of cutting bar 66 and the cutting points 142 and 156 of the respective blade means 120 and 122. The closer the pair of blade means 120 and 122 (including their associated points 142 and 156) are to the cutting bar 66, the less tendency or degree there is for any bowing or bending action of the moving uncut sheet material 12 immediately following passing over the apex 70 of the cutting bar 66.

Figure 12:
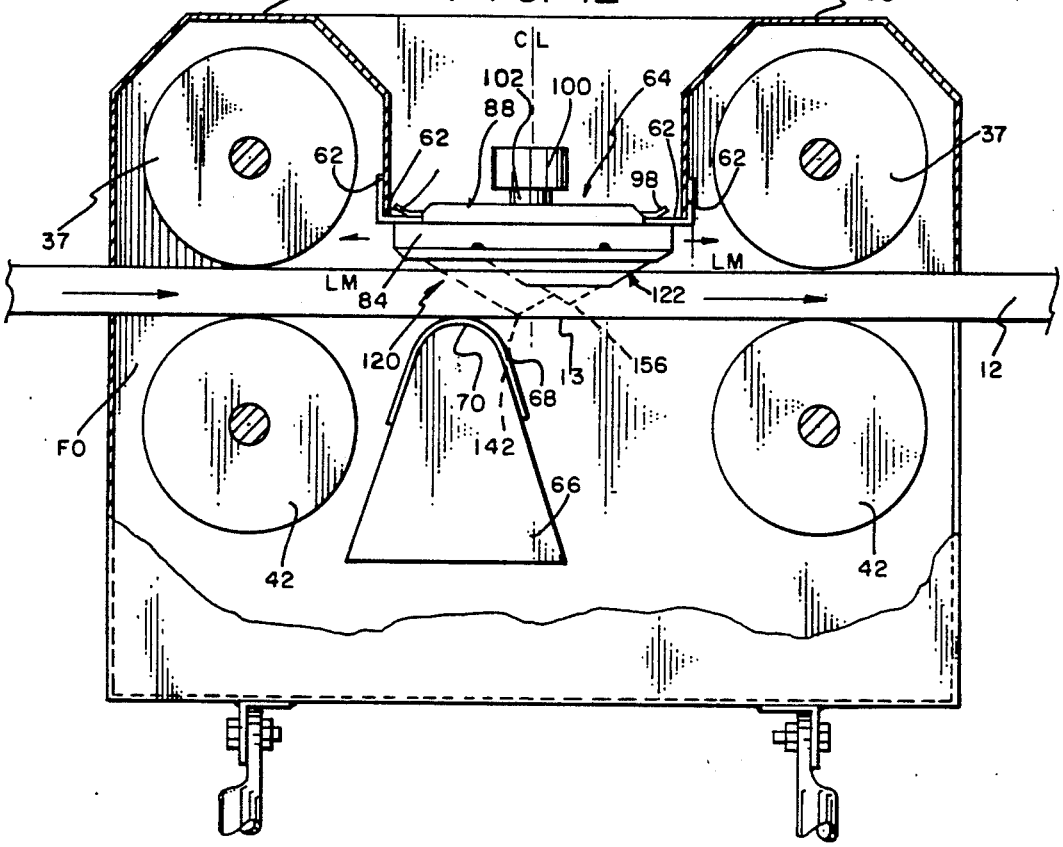
FIG. 12 is a partial vertical sectional view disclosing the cutting tool moved towards the cutting bar such as to effect a deeper cut into a sheet of material passing through the upper and lower rollers.
Figure 13:
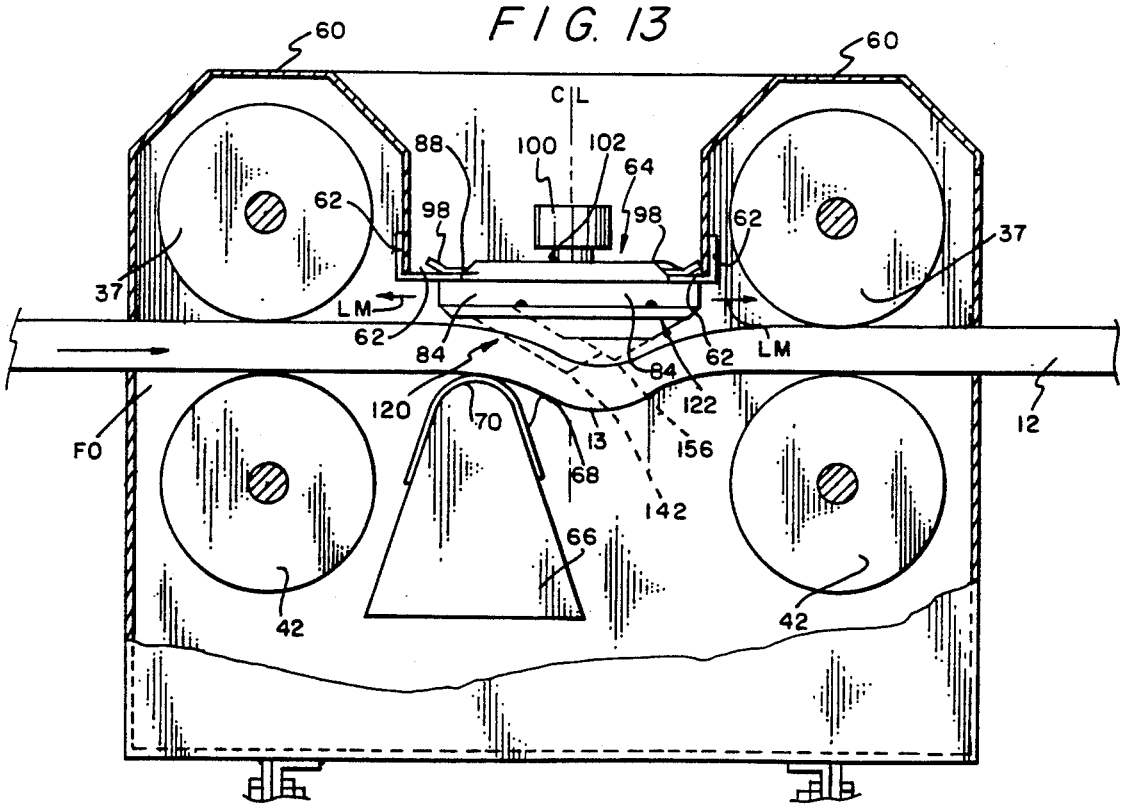
FIG. 13 is a partial vertical sectional view disclosing the cutting tool moved away from the feed opening and the cutting bar such as to effect a more shallow or a lesser depth of cut with the cutting tool than when the cutting tool is in the posture as illustrated in FIG. 12.

While a preferred embodiment of the invention is forming the cutting bar 66 in an off-set position with respect to the center line CL, it is to be understood that the present invention would include the cutting bar 66 centered, registered or aligned with the center line CL or on the opposite side thereof ((i.e. towards the upper roller 37 or bottom roller 42 disposed on the right of center line CL in FIG. 12). In or for such ann alternate embodiment, the blades of the blade support means 64 would have to be moved or positioned to the rear thereof to compensate for such alternate position (s) of the cutting bar 66. More specifically, referencing FIG. 12 and by way of example only, blades 120 and 122 would be moved or positioned further to the rear (or the right)) on the respective frame sides 84—84. This inherently causes the blades 120 and/or blades 122 to be disposed more towards the upper roller 37 or bottom roller 42 postured on the right of center line CL in FIG. 12.

In the manufacture of the duct board cutter machine of this invention, it is obvious that the machine can be constructed by machine fabricating techniques currently used in the art to manufacture machines of the same general type. The frame structures of the machine are relatively simple in design thus making it umcomplicated to manufacture. A quantity of blade support means (or cutting tools) can be manufactured to be used with the machine as they are usable individually or in quantity depending upon the quantity of formations to be cut in a sheet of material. As was previously indicated, mirror images of formations can be obtained by reversing a cutting tool relative to a cutting tool that produced the original formation in the sheet of material.

In the use and operation of the duct board cutter machine of this invention, it is seen that same provides a machine to cut formations in sheets of material such as fiberboard and fiberglass batting and other materials such as is used for forming ventilation ducts and the like. The machine will in use produce a formation or a plurality of formations or grooves in a sheet of material as it is moved through the machine. Since the machine has all the rollers thereof powered to rotate, the sheet of material is moved through the machine under the influence of these rollers and no idler rollers are included. The cutting tool portion of the machine is adapted to mount a single cutting tool or a plurality of cutting tools on a pair of spaced lips in the structure of a frame. The machine includes folding legs for easier carrying, transportation, or bench top or floor usage.

As will become apparent from the foregoing description of the applicant's duct board cutter machine, relatively simple and inexpensive means have been provided to cut formations or grooves in sheets of material. The duct board cutter machine is economical in that it is rapidly adjustable and has only powered rollers to move the sheet of material through the machine and guide same through the machine. The duct board cutter machine is simple to use in that adjustments for the machine are uncomplicated and easily done. And, additionally, the duct board cutter machine is safe to use in that the rollers thereof and cutting tools are well guarded by the structure of the machine for safety to prevent the induction of a worker's hands or clothing into the apparatus.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A machine for forming a formation in a sheet of material comprising:

a frame, said frame including a pair of spaced lips defining a generally rectangular opening having a center line;

a pair of upper rotatable rollers rotatably connected to said frame;

a pair of lower rotatable rollers rotatably connected to said frame;

a single stationary cutting bar secured to said frame underneath said rectangular opening and off-set with respect to said center line;

a powered means mounted to said frame for rotating said pair of upper rollers and said pair of lower rollers to move a sheet of material through said frame; and a blade assembly removably and slidably mounted to said pair of spaced lips and adapted to adjust laterally across said rectangular opening;

said blade assembly comprises a blade support having a frame top, a guide frame secured to said frame top, and a clamping bar removably secured to said guide frame, said clamping bar extending beyond said guide frame to form a space between the frame top and said clamping bar wherein said pair of spaced lips removably and slidably lodges such that said blade assembly can be moved laterally across said rectangular opening and to and away from each lip of said pair of spaced lips.

2. The machine of claim 1 wherein said guide frame is generally U-shaped and said clamping bar includes a pair of upturned lips at opposed ends thereof.

3. A machine for forming a formation in a sheet of material comprising:

a frame, said frame including a pair of spaced lips defining a generally rectangular opening having a center line;

a pair of upper rotatable rollers rotatably connected to said frame;

a pair of lower rotatable rollers rotatably connected to said frame;

a single stationary cutting bar secured to said frame underneath said rectangular opening and off-set with respect to said center line;

a powered means mounted to said frame for rotating said pair of upper rollers and said pair of lower rollers to move a sheet of material through said frame; and a blade assembly removably and slidably mounted to said pair of spaced lips and adapted to adjust laterally across said rectangular opening;

said blade assembly comprises a blade support having a frame top, a guide frame secured too said frame top, and a clamping bar removably secured to said guide frame, said clamping bar extending beyond said guide frame to form a space between the frame top and said clamping bar wherein said pair of spaced lips removably and slidably lodges such that said blade assembly can be moved laterally across said rectangular opening and to and away from each lip of said pair of spaced lips, said guide frame is generally U-shaped and said clamping bar includes a pair of upturned lips at opposed ends thereof; and additionally comprising a tool handle having a handle roof and a pair of sloping handle sides secured to the handle roof and to the upturned lips.

4. A machine for forming a formation in a sheet of material comprising:

a frame, said frame including a pair of spaced lips defining a generally rectangular opening having a center line;

a pair of upper rotatable rollers rotatably connected to said frame;

a pair of lower rotatable rollers rotatably connected to said frame;

a single stationary cutting bar secured to said frame underneath said rectangular opening and off-set with respect to said center line;

a powered means mounted to said frame for rotating said pair of upper rollers and said pair of lower rollers to move a sheet of material through said frame; and a blade assembly, said blade assembly comprises a blade support having a frame top, a guide frame secured to said frame top, and a clamping bar removably secured to said guide frame, said clamping bar extending beyond said guide frame to form a space between the frame top and said clamping bar wherein said pair of spaced lips removably and slidably lodges such that said blade assembly can be moved laterally across said rectangular opening and to and away from each lip of said pair of spaced lips, said guide frame is generally U-shaped and said clamping bar includes a pair of upturned lips at opposed ends thereof; and additionally comprising a frame shaft having a threaded shaft end and passing through the frame top and the guide frame and through the clamping bar; a hollow internally threaded shank member rotatably engaged to the threaded shaft end of the frame shaft, and a handle member integrally formed with the shank member.

5. The machine of claim 4 wherein said blade assembly additionally comprises a pair of frame sides integrally secured to the frame top and formed with a pair of channeled flanges.

* * * * *